US008543053B1

(12) United States Patent
Melamed et al.

(10) Patent No.: US 8,543,053 B1
(45) Date of Patent: Sep. 24, 2013

(54) WIRELESS COMMUNICATION JAMMING USING SIGNAL DELAY TECHNOLOGY

(76) Inventors: Howard Melamed, Coral Springs, FL (US); Daniel Fitzsimmons, Boca Raton, FL (US)

( * ) Notice: Subject to any disclaimer, the term of this patent is extended or adjusted under 35 U.S.C. 154(b) by 179 days.

(21) Appl. No.: 13/227,991

(22) Filed: Sep. 8, 2011

Related U.S. Application Data

(60) Provisional application No. 61/503,425, filed on Jun. 30, 2011.

(51) Int. Cl.
*H04K 3/00* (2006.01)

(52) U.S. Cl.
USPC ..... 455/1; 455/67.13; 455/63.1; 455/226.1

(58) Field of Classification Search
USPC ..... 455/1, 67.13, 67.11, 63.1, 69, 522, 455/452.1, 456.4, 501, 226.1, 245.1, 250.1; 342/81, 374, 14, 157; 375/345, 224
See application file for complete search history.

(56) References Cited

U.S. PATENT DOCUMENTS

2004/0130488 A1* 7/2004 De Champlain ..... 342/374
2006/0188033 A1* 8/2006 Zehavi et al. ..... 375/260
2009/0174589 A1* 7/2009 Moraites ..... 342/14
2012/0299765 A1* 11/2012 Huang et al. ..... 342/81

* cited by examiner

*Primary Examiner* — John J Lee
(74) *Attorney, Agent, or Firm* — Malloy & Malloy, P.L.

(57) ABSTRACT

A device and method for jamming wireless communication devices where the jamming signal is derived from the downlink signal of the base station and processed with a time delay sufficient length as to prevent the base station receiver from correctly processing the responding uplink signal from the targeted wireless communications device. Such wireless communication jamming device can be used by law enforcement and authorized government entities to block the operation of wireless communication devices such as cell phones within a target area.

25 Claims, 5 Drawing Sheets

PRESENT INVENTION – DUAL BAND

TYPICAL WIRELESS COMMUNICATION JAMMER

PRESENT INVENTION –
SINGLE BAND

PRESENT INVENTION – DUAL BAND

PRESENT INVENTION – EXAMPLE DEPLOYMENT

WIRELESS COMMUNICATION JAMMING USING SIGNAL DELAY TECHNOLOGY

CLAIM OF PRIORITY

The present application is based on and a claim of priority is made under 35 U.S.C. Section 119(e) to a provisional patent application that is currently pending in the U.S. Patent and Trademark Office, namely, that having Ser. No. 61/503,425 and a filing date of Jun. 30, 2011, and which is incorporated herein by reference.

BACKGROUND OF THE INVENTION

1. Field of the Invention

The present invention relates to wireless communication jammers in environments where inhibiting wireless communications is desired and further relates to wireless communication jammers that prevent wireless communication devices such as cell phones, two way radios, smart phones, WiFi enabled computers and devices, and personal digital assistants from communicating. The category of the present invention is sometimes referred to in the prior art as wireless communications jamming, RF jamming, radio frequency jamming, cell phone blocking, and/or cell phone jamming.

2. Description of Related Art

Wireless communications devices have become increasingly common. At times, it is desirable to block wireless communications from occurring in specific areas. An example of an area that may require communication device blocking are the facilities within prisons where inmates are housed. Areas that require blocking are referred to as target areas when deploying a wireless communications jammer.

Wireless communication jammers are utilized by government agencies with legal authority to permit or deny usage of the wireless frequency spectrum. An industry for wireless communication jamming devices has developed in response to these needs. A number of wireless communication jamming technologies have developed and advances in technologies have occurred.

Most prior art wireless communication jamming systems are comprised of a signal generation device which feeds a signal into a power amplifier which in turn feeds a transmitting antenna. The transmitting antenna emits radio frequency signals on the same frequencies that the target wireless device uses. This interferes with the reception of the target signal and prevents the target wireless device from communicating.

FIG. 1 is a block diagram of the typical prior art wireless communications jammer system including a signal generator 1, a power amplifier 2, an optional output filter 3, and a transmitting antenna 4. The components of the jamming system with exception of the transmitting antenna are typically housed together in enclosure 5.

The most common type of prior art wireless jamming is barrage jamming in which a jamming signal is produced which sweeps across the entire target frequency band. A barrage type jamming system has the advantages of being simple and effective and remains effective over time even if the target signals within the jammed frequency band change frequencies or protocols. The disadvantage of a barrage type jammer is that it is relatively inefficient in that the output power of the jammer is spread across frequencies that do not require jamming. This results in lower jamming effectiveness and increased heating of the power amplifier. The increased heating of the power amplifier is detrimental to the reliability of the jammer.

A second type of prior art jammer exists and is called a frequency specific jammer, where the jammer produces jamming signals only on the frequencies within the target frequency band that require jamming. The signal generators of these systems use digital technology. This type of system has the advantage of producing higher output power at the target frequencies. The disadvantage of this type of system is that it must be pre-programmed with the exact frequencies that require jamming. This pre-programming requirement increases the cost of deploying such a system. This type of system also has the disadvantage of being less reliable over time because the specific frequencies and protocols used within a target frequency band often change. A third disadvantage of this type of system is that the signal generation circuitry is more complex resulting in an inherent decrease in reliability.

A variation of the barrage type jammer and the frequency specific jammer is the reactive type jammer. This type of jammer produces jamming signals only when a target signal is detected. This type of jammer can be a barrage type jammer or a frequency specific jammer. This technology has the advantage of increasing the efficiency of the power amplifier and jamming system. The disadvantage of this type of jammer is that it increases the complexity to the system. This additional complexity increases the cost of the system and decreases reliability. Another disadvantage of the reactive type jammer is that it is not always effective against short burst communications because of the delay between the time of detection of the target signal and the commencement of the jamming signal in response.

For all types of jamming systems, the effectiveness of the system is constrained by the output power of the jammer power amplifier. In order for a jamming to occur, the jamming signal power must be higher than the power level of the target signal.

Spread spectrum wireless communication technologies such as CDMA and WCDMA are becoming increasingly common because of their increased spectral efficiency when deployed in a cellular environment. Spread spectrum communication is inherently difficult to jam. This increased use of spread spectrum protocols is increasing the need for greater jammer efficiency.

Cell phone and many other wireless communications protocols make use of a frequency division duplexing scheme where a frequency range is dedicated for transmissions from the base station to the mobile communications device and a separate frequency range is used for transmissions from the mobile device to the base station. The communication that occurs from the mobile device to the base station is called the uplink communication and the communication from the base station to the mobile device is called the downlink communication. Properly designed jamming systems must take into account the specific uplink or downlink frequency bands that require jamming.

There is a need for a wireless communication jammer that incorporates a signal generation method that has the simplicity and reliability of a barrage type jammer but that also provides the greater efficiency provided a frequency specific and reactive jammer. There is also a need for a jammer signal generation method that provides greater efficiency in jamming spread spectrum type signals such as CDMA and WCDMA.

SUMMARY OF THE INVENTION

The present invention is a device and method for jamming wireless communication devices where the jamming signal is derived from the downlink signal of the base station and processed with a time delay of sufficient length as to prevent the base station receiver from correctly processing the responding uplink signal from the wireless communications device that is being jammed.

The advantage of the present invention over related prior art technology is that it produces a jamming signal that is 15 to 25 dB more effective than a barrage type jammer.

Another advantage of the present invention over prior art also is that it produces a jamming signal that is 10 to 15 dB more effective than a frequency specific wireless jammer.

Yet another advantage of the present invention is that it has a lower level of electrical circuit complexity than prior art barrage type wireless jammers. This results in higher reliability over this type of jammer.

Yet another advantage of the present invention is that is has a lower level of complexity than prior art frequency specific wireless jammers. This results in both higher reliability and decreased configuration complexity over this type of jammer.

Yet another advantage of the present invention over prior art reactive type jamming is that it affects an instantaneous response to short burst type communications. This is because the wireless device that is being jammed by the present invention has locked on to the false jamming signal before the short burst communications have occurred, whereas with a reactive type jammer, a jamming signal is only produced after a target signal is detected.

Yet another advantage of the present invention over prior art jammers is that because the present invention is self adjusting and tailored to the target frequencies within the jammers target frequency bands, the present invention requires a lower amount of power to affect jamming of the target signal. This results in less disruption to out of target area communications.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
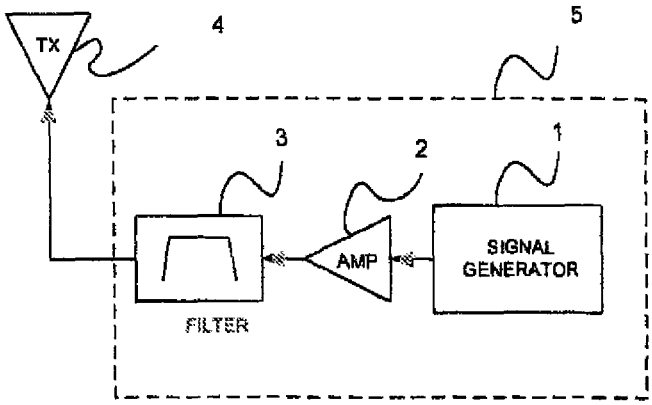
FIG. 1 PRIOR ART
FIG. 1 is a general block diagram of a typical prior art wireless communication jammer.
Figure 2:
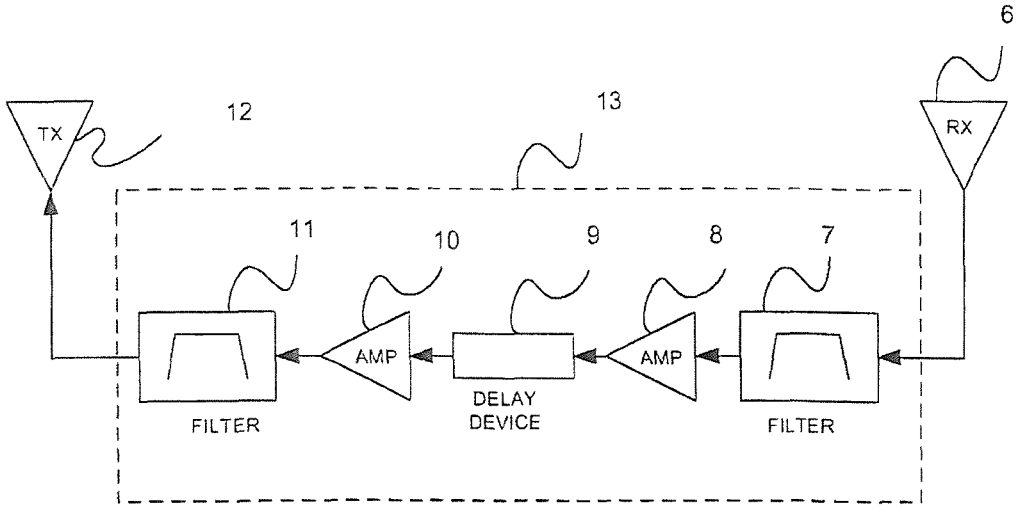
FIG. 2 is a general block diagram of the present invention in a single frequency band embodiment.

In FIG. 2, a block diagram of the present invention with a single frequency band embodiment is shown. The jammer system is comprised of the jammer 13, the jammer transmitting antenna 12, and the jammer receiving antenna 6. The jamming system operates by receiving the target downlink signal via the receiving antenna 6. The receiving antenna 6 is connected to the jamming system via RF coaxial cable which feeds through band pass filter 7. The purpose of the band pass filter 7 is to restrict and define the frequency band that is to be jammed. An example target frequency band is 1930-1990 MHz, which is the USA PCS downlink band or the 869-894 MHz frequency band which is the USA Cellular downlink frequency band. Other frequency bands are possible. The target frequency band and number of target frequency bands is dependent upon the location of the jamming system and the signals present at the jamming system location. The signal from the band pass filter 7 is fed through the RF preamplifier 8 to bring it up to an adequate level to be fed through the delay device 9.

The delay device 9 is typically comprised of single mode fiber optic cable and a transceiver set to convert the signal from RF to optical energy and vice versa. In one preferred embodiment, the signal delay device 9 consists of 60 km of single mode fiber optic cable and a fiber optic transceiver at the beginning and end of the fiber optic cable for conversion purposes. The 60 km of fiber optic cable results in a signal delay of 200 microseconds.

An alternative embodiment of the delay device is the use of surface acoustic wave filters or bulk acoustic wave filters although these technologies have the disadvantage of being narrow band resulting in multiple filters being required to jam a wide frequency band.

The signal from the delay device 9 is fed into a power amplifier 10 and the signal from the power amplifier 10 is fed through band pass filter 11. The band pass filter 11 is used to attenuate any out of band RF emissions that may potentially interfere with non-target communication.

The output of bandpass filter 11 is fed via a coaxial cable to transmitting antenna 12. Transmitting antenna 12 is comprised of a single antenna or a plurality of antennas.

Figure 3:
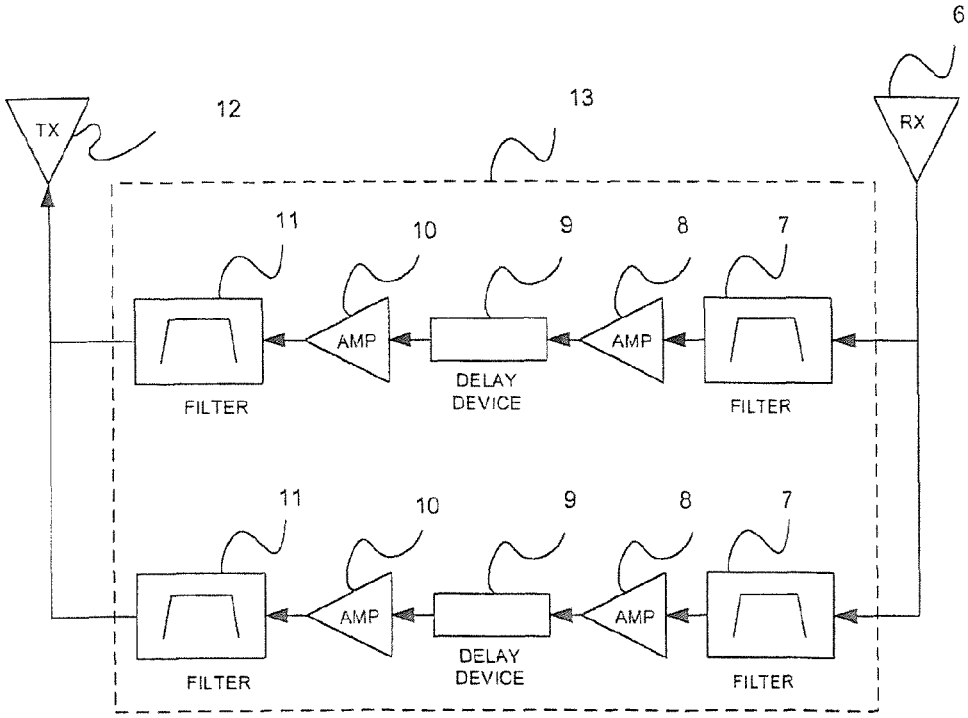
FIG. 3 is a general block diagram of the present invention in a dual frequency band embodiment.

FIG. 3 shows an alternative embodiment where jammer 13 is comprised of 2 circuits operating in parallel. The use of two parallel circuits is to accommodate two frequency bands simultaneously. Other embodiments include more than two parallel jammer circuits to accommodate more than two frequency bands simultaneously.

In FIG. 3, separate delay devices 9 are provided for each of the two frequency bands. An alternate embodiment is for multiple frequency bands to share the same delay device via the use of band pass filter type combiners. The preamplifiers 8, in this case would feed a filter/combiner which would combine the signals into a single band which would then be fed through a single delay device 9. The output of the delay device would then be split back into separate frequency bands via a filter/combiner and each frequency band would be fed into its own power amplifier 10.

Another embodiment is one where multiple frequency bands share the same power amplifier, although this results in less RF output power.

Figure 4:
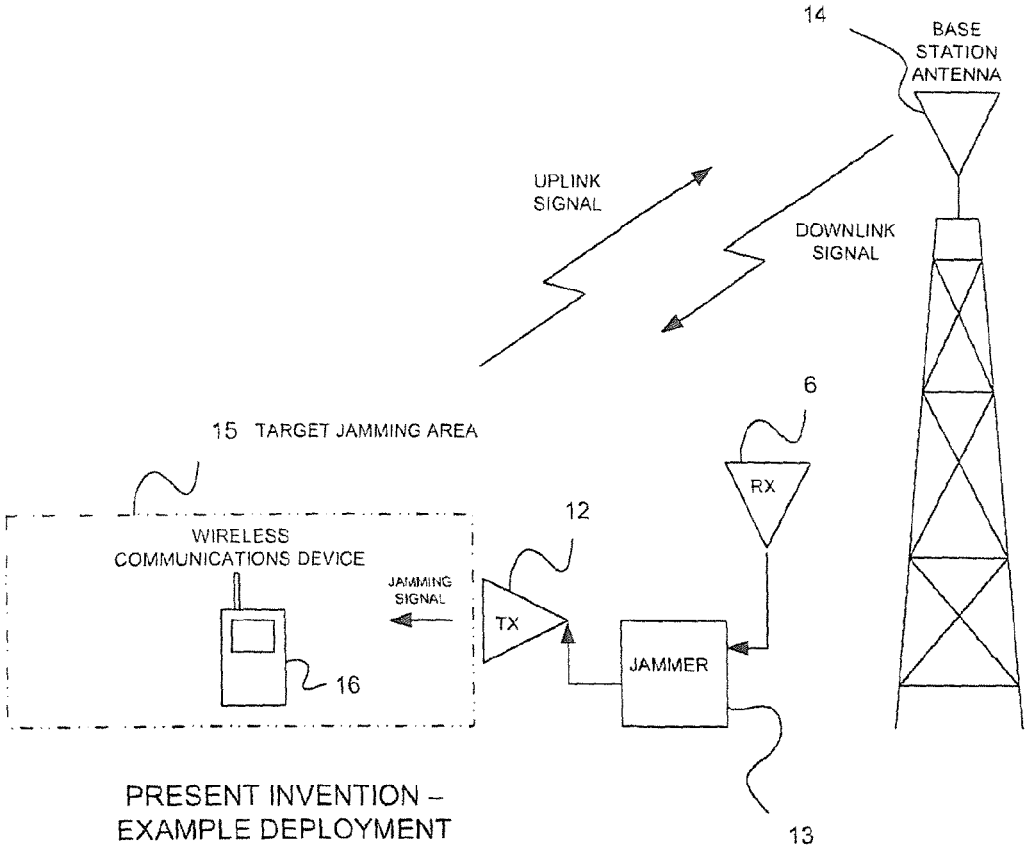
FIG. 4 depicts a front elevational view in schematic form of an example deployment of the present invention.

FIG. 4 illustrates an example deployment of the present invention. The receiving antenna 6, receives the target downlink signal from the base station antenna 14. The receiving antenna 6 is placed outside the target jamming area 15 in order to prevent feedback of the downlink signal from the transmitting antenna 12 back into the receiving antenna 6.

The receiving antenna 6 must have adequate RF isolation from the transmitting antenna 12 in order to prevent feedback and oscillation from occurring. This isolation must be 15 dB greater than the RF gain of the system as measured from the off-the-air input into the receiving antenna 6 to the RF output of the transmitting antenna 12. This isolation is typically accomplished by the use of directional antennas, physical distance between the antennas, and the use of obstacles such as walls or buildings between the antennas.

Another embodiment to achieve the necessary isolation between the transmitting and receiving antennas is to include a signal cancellation circuit. This type of circuit is well known and available for bi-directional amplifier repeater applications. The signal cancellation circuit acts by inserting an inverse signal that compensates for any feedback signal that may occur.

FIG. 4 also illustrates a target wireless mobile device 16 within the target jamming area 15.

Figure 5A:
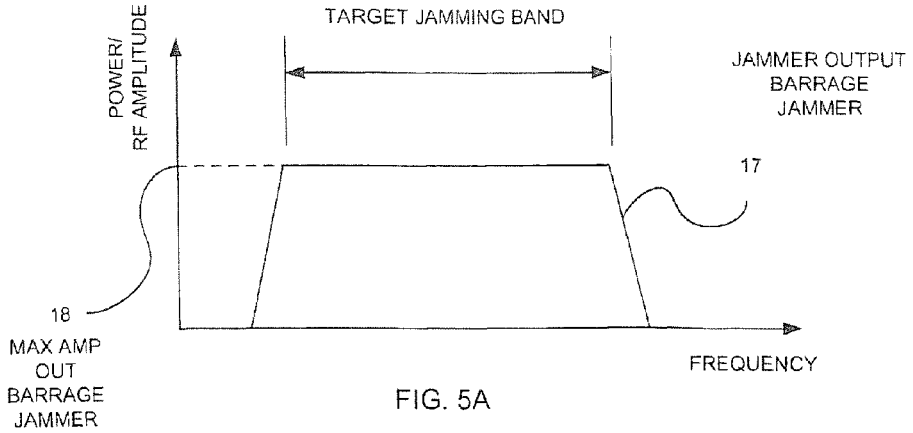
FIG. 5A is a frequency diagram showing a representation of the jamming signal output of a barrage type jammer.

FIG. 5A illustrates the output signal 17 of a jammer power amplifier that utilizes barrage type jamming across the full target frequency band. The output power is constrained by the limits of the power amplifier to the output level indicated by 18.

Figure 5B:
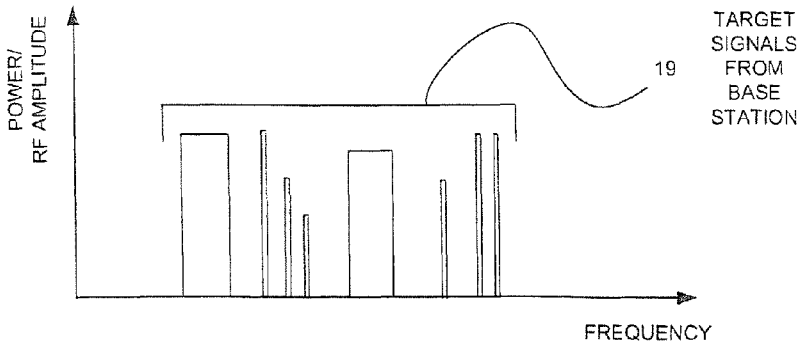
FIG. 5B is a frequency diagram showing a representation of the signals present in a typical target frequency band.

FIG. 5B illustrates an example of the typical target signals 19 from the base station. These are downlink signals that fall within the target frequency band that requires jamming. Note that the scale of the vertical axis of FIG. 5B is smaller than FIG. 5A and FIG. 5C. The typical target signals from the base station are −50 dBm to −100 dBm in amplitude, whereas the typical output from a jammer amplifier is 0 dBm to 50 dBm. The signals 19 are dynamic and changing rapidly over time and are typically comprised of a combination of CDMA, WCDMA and GSM signals.

Figure 5C:
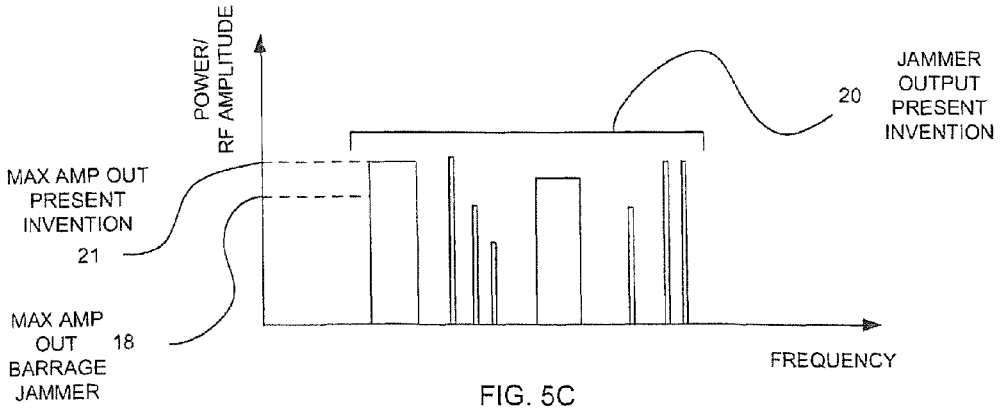
FIG. 5C is a frequency diagram showing a representation of the jamming signal output of the present invention.

FIG. 5C illustrates the resulting jamming output signal 20 of the present invention. The resulting jamming output signal closely follows the target signals that are to be jammed. The resulting maximum output power 21 of the jamming signal 20 is appreciably higher than the maximum output signal of the barrage type jammer 18. The degree of increase of the maximum jamming signal is dependent on the composition of the target signals from the tower. Based on tests and measurements of the present invention, the increase can be expected to range from 10 to 15 dB.

The present invention operates by producing a continuous non-distorted signal which induces target wireless devices to engage or lock onto the jamming signal because the jamming signal has a power level that is appreciably higher than the original downlink signal from the base station. The jamming signal is time delayed to an extent that when the target wireless communications device responds with an uplink communication to the base station, the signal arrives at too late of a time to be correctly processed by the base station. This is unlike typical wireless jamming technologies that cause disruption to communications by producing a signal on the same frequency and at the same time as the target communications.

Current cell phone and wireless communication devices make use of technologies of several types. Among the types that are used are GSM, CDMA, and WCDMA over the air protocols. Of these types, spread spectrum technology such as CDMA and WCDMA is becoming increasingly common because of its increased spectral efficiency. This type of communication is inherently difficult to jam. The present invention overcomes the jamming defense posed by spread spectrum technologies. This results in the present invention having a gain of 10 to 15 dB in effectiveness over these types of signals. This 10 to 15 dB improvement is in addition to the 10 to 15 dB improvement provided by the present invention in power amplifier efficiency over barrage type jamming. The resulting improvement in efficiency of the present invention is 20 to 30 dB over previous art barrage type jamming and a 10 to 15 dB improvement in efficiency over frequency specific jamming.

Further advantages over prior art is that the signal generation method requires circuitry that is less complex and more widely available. This results in greater reliability.

Yet, another advantage of the present invention over prior art is that the system is self adjusting. This is because the jamming signal is based on the target signal that is to be jammed, thus the jamming signal will follow the target signal automatically in frequency and amplitude with little operator intervention and with less initial configuration.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A method of jamming communication of a wireless communication device within a target area, the method comprising:

receiving a target signal downlinked from a base station communicating within the target area, delaying the target signal to create a delayed target signal, amplifying the delayed target signal to a predetermined power level greater than the power level of the downlinked target signal as received from the base station, creating a jamming signal by amplifying the delayed target signal to the predetermined power level and sufficiently increasing the predetermined power level to a degree sufficient to induce the wireless communication device to lock onto the jamming signal, and causing the wireless communication device to uplink on a sufficiently delayed basis to be incorrectly processed by the base station.

2. A method as recited in claim 1 comprising receiving the target downlinked signal by receiving antenna facilities located outside the target area.

3. A method as recited in claim 2 comprising including a transmitting antenna facility to communicate the jamming signal to the communication device.

4. A method as recited in claim 3 comprising isolating the receiving antenna facility located outside the target area from the transmitting antenna facility.

5. A method as recited in claim 1 comprising pre-amplifying the power level of the target downlinked signal sufficiently to facilitate the processing of the downlinked signal for delay.

6. A method as recited in claim 1 comprising filtering the downlinked signal to define a frequency band to be jammed.

7. A method as recited in claim 6 comprising filtering the jamming signal to attenuate out band radio frequency emissions.

8. A method as recited in claim 1 comprising filtering the jamming signal to attenuate out band radio frequency emissions.

9. A method as recited in claim 1 further comprising simultaneously receiving target downlinked signals having different frequency bands; separately amplifying the target downlinked signals; creating independent jamming signals by independently amplifying the delayed target signals each to a predetermined power level sufficient to induce the wireless communication device to lock onto the created jamming signals and causing the wireless communication device to uplink on a sufficiently delayed basis to be incorrectly processed by the base station.

10. A method as recited in claim 9 processing the target downlinked signals simultaneously in parallel.

11. A method as recited in claim 1 generating the jamming signal to include a continuous non-distorted signal having a predetermined power level that is sufficiently higher than the original downlinked signal from the base station to induce a target wireless device to lock onto the jamming signal.

12. A system for jamming communication of a wireless communication device within a target area, the system comprising:

a jamming assembly including at least one jamming circuit comprising a signal delay device, a receiving antenna assembly disposed and structured to receive a downlinked target signal, said signal delay device operative to establish a predetermined delay in communicating the downlinked target signal, said one jamming circuit comprising a power amplifier operative to amplify power level of the downlinked target signal as received by receiving antenna assembly, a transmitting antenna assembly structured to emit jamming signal within the target area, said signal delay device, said power amplifier facility and said transmitting antenna facility collectively operative to create a delayed jamming signal having a sufficient power level to induce the wireless communication device to lock onto the jamming signal.

13. A system as recited in claim 12 wherein said receiving antenna assembly is located outside the target area.

14. A system as recited in claim 12 wherein said receiving antenna assembly and said transmitting antenna assembly are isolated from one another.

15. A system as recited in claim 12 wherein said one jamming circuit further comprises a pre-amplifier facility disposed and structured to amplify the downlinked target signal to a power level sufficient to facilitate processing thereof by the delay device.

16. A system as recited in claim 12 said one jamming circuit further comprising a first band filter facility disposed and structured to restrict and define a frequency band of the target downlinked signal.

17. A system as recited in claim 16 wherein said one jamming circuit comprises a second band filter disposed and structured to attenuate the band radio frequency emissions of the jamming signal.

18. A system as recited in claim 12 wherein said one jamming circuit comprises a second band filter disposed and structured to attenuate the band radio frequency emissions of the jamming signal.

19. A system as recited in claim 12 wherein said jamming assembly comprises a plurality of jamming circuits each including a delay device; said receiving antenna assembly structured to direct downlinked target signals to each of said jamming circuits; each of said delay devices operative to establish a predetermined time delay in communicating corresponding ones of the downlinked target signals; each of said jamming circuits comprising a power amplifier facility operative to amplify the power level of corresponding ones of the target downlinked signals received from the receiving antenna assembly; the delay device and said power amplifier of each said jamming circuits collectively operative to create separate delayed jamming signals having a sufficient power level to induce the wireless communication device to lock onto corresponding jamming signals, and a transmitting antenna assembly structured to emit the jamming signal within the target area.

20. A system as recited in claim 19 wherein said plurality of jamming circuits are structured for simultaneous, parallel operation.

21. A system as recited in claim 19 wherein said receiving antenna assembly is located outside the target area.

22. A system as recited in claim 19 wherein each of said jamming circuits further comprises a pre-amplifier facility disposed and structured to amplify corresponding downlinked target signals to a power level sufficient to facilitate processing thereof by the corresponding delay device.

23. A system as recited in claim 19 wherein each of said jamming circuits includes a first band filter facility disposed and structured to restrict and define a frequency band of the corresponding downlinked target signals.

24. A system as recited in claim 23 wherein each of said jamming circuits includes a second band filter disposed and structured to attenuate the band radio frequency emissions of the corresponding jamming signal.

25. A system as recited in claim 12 wherein said one jamming circuit comprises a second band filter disposed and structured to attenuate the band radio frequency emissions of the jamming signal.

* * * * *